US011756356B2

(12) United States Patent
Ho et al.

(10) Patent No.: US 11,756,356 B2
(45) Date of Patent: Sep. 12, 2023

(54) SYSTEM AND METHOD FOR CONTROLLING MULTIPLE LOCKS

(71) Applicant: IGLOOCOMPANY PTE. LTD., Singapore (SG)

(72) Inventors: Khee Kien Ho, Singapore (SG); Eric Chun Chiang Chan, Singapore (SG); Johannes Dwiartanto, Singapore (SG); Matthew Mantik Ng, Singapore (SG)

(73) Assignee: IGLOOCOMPANY PTE. LTD., Singapore (SG)

( * ) Notice: Subject to any disclaimer, the term of this patent is extended or adjusted under 35 U.S.C. 154(b) by 25 days.

(21) Appl. No.: 17/638,906

(22) PCT Filed: Oct. 27, 2020

(86) PCT No.: PCT/SG2020/050614
§ 371 (c)(1),
(2) Date: Feb. 28, 2022

(87) PCT Pub. No.: WO2021/040628
PCT Pub. Date: Mar. 4, 2021

(65) Prior Publication Data

US 2022/0301370 A1 Sep. 22, 2022

(30) Foreign Application Priority Data

Aug. 28, 2019 (SG) ..... 10201907949R

(51) Int. Cl.
*G07C 9/00* (2020.01)
*G07C 9/33* (2020.01)

(52) U.S. Cl.
CPC ..... *G07C 9/00309* (2013.01); *G07C 9/33* (2020.01); *G07C 2009/00515* (2013.01)

(58) Field of Classification Search
None
See application file for complete search history.

(56) References Cited

U.S. PATENT DOCUMENTS 9,766,828 B2 * 9/2017 Hughes, Jr. ..... G06F 3/0622
9,875,592 B1 * 1/2018 Erickson ..... G07C 9/00309
(Continued)

FOREIGN PATENT DOCUMENTS

JP 05231054 A 9/1993
KR 101636025 B1 7/2016
(Continued)

OTHER PUBLICATIONS

International Search Report and Written Opinion of International Searching Authority for International Application No. PCT/SG2020/050614.

*Primary Examiner* — Carlos Garcia
(74) *Attorney, Agent, or Firm* — JCIP; Joseph G. Chu; Jeremy I. Maynard

(57) ABSTRACT

A method for controlling access to a restricted physical space comprising: assigning a plurality of electronic locks to a lock group, transmitting authentication credentials to a plurality of electronic locks, authenticating the lock control device, by each of the plurality of electronic locks, in response to a successful authentication of the authentication credentials, receiving, by the lock control device, an input gesture on an input unit, determining, by the lock control device, that the input gesture corresponds to an enrolled input gesture associated with the lock group and transmitting a control signal to each of the plurality of locks associated to the lock group in response to a successful match of the input gesture with the enrolled input gesture associated with the lock group so as to cause each of the plurality of locks associated with the lock group to be in the activated state simultaneously.

20 Claims, 10 Drawing Sheets

(56) References Cited

U.S. PATENT DOCUMENTS

| | | | | |
|---|---|---|---|---|
| 2017/0148243 | A1* | 5/2017 | Shin | G07C 9/00309 |
| 2019/0172287 | A1 | 6/2019 | Kaye et al. | |

FOREIGN PATENT DOCUMENTS

| | | | |
|---|---|---|---|
| KR | 1020170071869 | A | 6/2017 |
| KR | 1020170081930 | A | 7/2017 |

* cited by examiner

SYSTEM AND METHOD FOR CONTROLLING MULTIPLE LOCKS

TECHNICAL FIELD

The present disclosure generally relates to electronic locks. More particularly, the present disclosure relates to a system and method for controlling multiple electronic locking devices with a single input gesture.

BACKGROUND

The following discussion of the background to the invention is intended to facilitate an understanding of the present invention. However, it should be appreciated that the discussion is not an acknowledgment or admission that any of the material referred to was published, known or part of the common general knowledge in any jurisdiction as at the priority date of the application.

There are many types of locks are available in the market such as deadbolts, latches, rim locks and mortise locks. These locks are used to secure and prevent access to a restricted area. In most cases, a single lock in sufficient to secure such access. With the advent of new wireless technologies such as Bluetooth, there are solutions in the prior art that utilize wireless technologies to send cryptographic secret keys to unlock a lock.

However there are many situations where multiple locks are used. For example, it is prevalent to have a metal gate in front of a wooden door (FIGS. 1 and 2) in apartments in countries such as Singapore. It is complicated to opening multiple locks at multiple lock points for the user as multiple unlock actions has to be taken by the user. In the example above, the metal gate is usually secured by a padlock and the wooden door is secured by a deadbolt or mortise. The user in this example, has to put in the key to unlock the padlock securing access to the metal gate, then put in the key to unlock the deadbolt securing access to the wooden door. The complexity of increases with each additional locking point added.

There are solutions in the prior art that focus on solving this complex problem of opening multiple locks. Many solutions in the prior art focuses on the achieving the unlocking of multiple locks via mechanical means. There are other solutions that focus on having the locks interconnected to each other wirelessly, such that the event of unlocking one lock will trigger the opening of the other locks in a coordinated manner In another solution from prior art, a preprogrammed key fob stores multiple keys where the key fob unlocks a single lock, but one at a time.

SUMMARY OF THE INVENTION

Throughout this document, unless otherwise indicated to the contrary, the terms "comprising", "consisting of", and the like, are to be construed as non-exhaustive, or in other words, as meaning "including, but not limited to".

According to a first aspect of the invention, there is provided a method for controlling access to a restricted physical space, the method being performed by one or more processors of a computing system, comprising, assigning a plurality of electronic locks to a lock group, wherein each of the plurality of electronic locks are associated with a physical barrier in the restricted physical space, transmitting authentication credentials to each of the plurality of electronic locks when a lock control device enters an active space of the restricted physical space. The steps further include authenticating the lock control device, by each of the plurality of electronic locks, in response to a successful authentication of the authentication credentials, receiving, by the lock control device, an input gesture on an input unit, determining, by the lock control device, that the input gesture corresponds to an enrolled input gesture associated with the lock group and transmitting a control signal to each of the plurality of locks associated to the lock group in response to a successful match of the input gesture with the enrolled input gesture associated with the lock group so as to cause each of the plurality of locks associated with the lock group to be in the activated state simultaneously.

Preferably, the control signal comprises an unlock signal.

Preferably, the control signal comprises a lock signal.

Preferably, each of the plurality of locks in the activated state is unlocked simultaneously.

Preferably, each of the plurality of locks in the activated state is locked simultaneously.

Preferably, the input gesture includes any one of the following: a pattern, a figure or a press.

Preferably the enrolled input gesture is configured to map to the lock group corresponding to each of the plurality of locks.

Preferably, the step of determining that the input gesture corresponds to the enrolled input gesture comprises comparing the input gesture with at least one predetermined input gesture stored as the enrolled input gesture.

Preferably, the method further includes activating, in response to a successful authentication of the authentication credentials, an input unit on the display of the lock control device for receiving an input gesture of the user.

Preferably, the method further includes receiving, by the each of the plurality of electronic locks, a notification that the each of the plurality of electronic locks are in the unlocked state.

Preferably, the authentication credentials is any one of the following: a unique passcode, a Bluetooth key, a secret cryptographic key or a biometric signature.

Preferably, the active space is a predetermined virtual perimeter from the lock group.

Preferably, the lock control device is a key fob.

Preferably, the lock control device is a mobile device.

According to a second aspect of the invention, there is provided an electronic lock configured to control access to a restricted physical space, the electronic lock being one of a plurality of electronic locks associated with a lock group configured to control the plurality of electronic locks simultaneously, the electronic lock comprising: a lock controller; a processor; and a memory storing instructions that, when executed by the processor, causes the electronic lock to receive authentication credentials from a lock control device when the lock control device enters an active space of the restricted physical space, authenticate the lock control device in response to a successful authentication of the authentication credentials, receive a control signal from the lock control device, the control signal being sent to the plurality of locks associated with the lock group, in response to a successful match of an input gesture with the enrolled input gesture associated with the lock group so as to cause the electronic lock and the plurality of locks associated with the lock group to be in the activated state simultaneously.

Preferably, the control signal comprises an unlock signal.

Preferably, the control signal comprises a lock signal.

Preferably, the electronic lock and the plurality of locks associated with the lock group in the activated state is unlocked simultaneously.

Preferably, the electronic lock and the plurality of locks associated with the lock group in the activated state is locked simultaneously.

Preferably, the input gesture includes any one of the following: a pattern, a figure or a press.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. The dimensions of the various features or elements may be arbitrarily expanded or reduced for clarity. In the following description, various embodiments of the invention are described with reference to the following drawings, in which:

FIG. 6(*b*) shows a user interface display of an input unit on the lock control device according to various embodiments;

DETAILED DESCRIPTION

Figure 1:
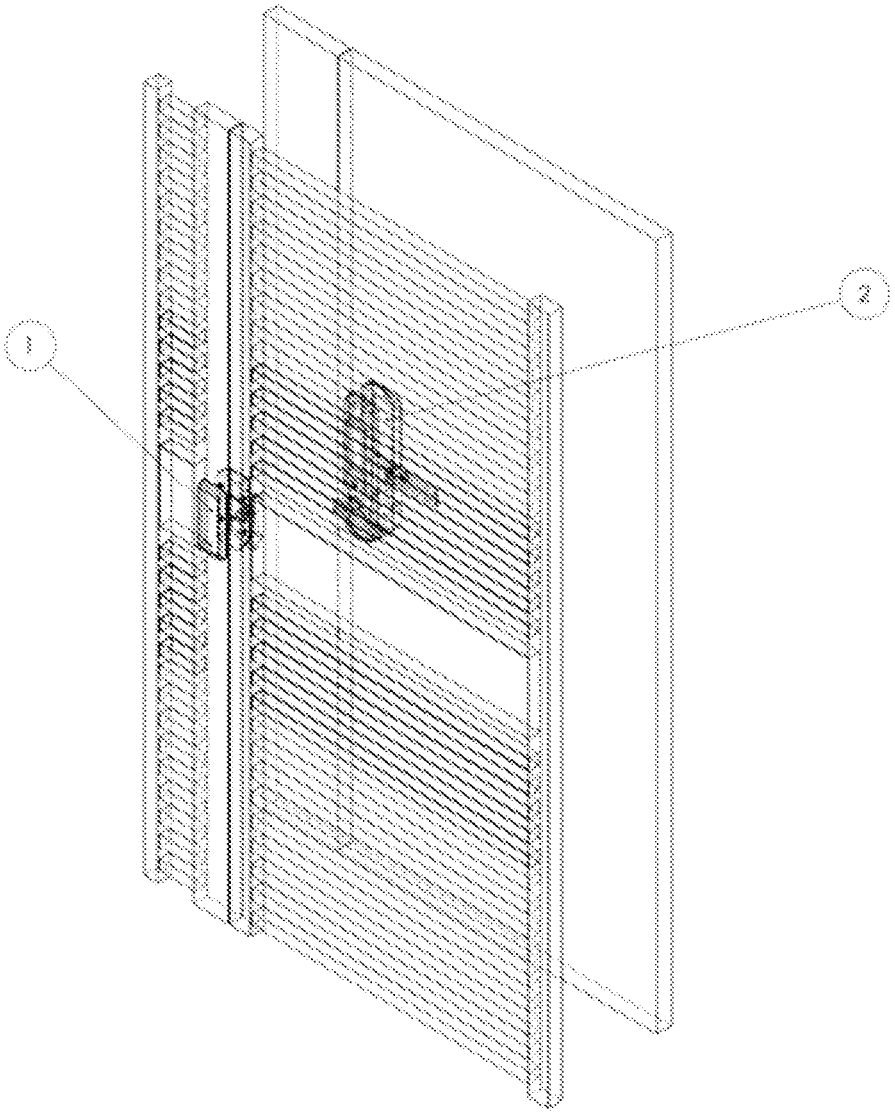
FIG. 1 shows a perspective view of a setup of a first physical barrier in front of a second physical barrier according to various embodiments.

The following detailed description refers to the accompanying drawings that show, by way of illustration, specific details and embodiments in which the invention may be practiced. These embodiments are described in sufficient detail to enable those skilled in the art to practice the invention. Other embodiments may be utilized and structural, and logical changes may be made without departing from the scope of the invention. The various embodiments are not necessarily mutually exclusive, as some embodiments can be combined with one or more other embodiments to form new embodiments.

By way of example, an element, or any portion of an element, or any combination of elements may be implemented as a "processing system" that includes one or more processors. Examples of processors include microprocessors, microcontrollers, graphics processing units (GPUs), central processing units (CPUs), application processors, digital signal processors (DSPs), reduced instruction set computing (RISC) processors, systems on a chip (SoC), baseband processors, field programmable gate arrays (FPGAs), programmable logic devices (PLDs), state machines, gated logic, discrete hardware circuits, and other suitable hardware configured to perform the various functionality described throughout this disclosure. One or more processors in the processing system may execute software. Software shall be construed broadly to mean instructions, instruction sets, code, code segments, program code, programs, subprograms, software components, applications, software applications, software packages, routines, subroutines, objects, executables, threads of execution, procedures, functions, etc., whether referred to as software, firmware, middleware, microcode, hardware description language, or otherwise.

Accordingly, in one or more example embodiments, the functions described may be implemented in hardware, software, or any combination thereof. If implemented in software, the functions may be stored on or encoded as one or more instructions or code on a computer-readable medium.

In the specification the term "comprising" shall be understood to have a broad meaning similar to the term "including" and will be understood to imply the inclusion of a stated integer or step or group of integers or steps but not the exclusion of any other integer or step or group of integers or steps. This definition also applies to variations on the term "comprising" such as "comprise" and "comprises".

In order that the invention may be readily understood and put into practical effect, particular embodiments will now be described by way of examples and not limitations, and with reference to the figures. It will be understood that any property described herein for a specific system may also hold for any system described herein. It will be understood that any property described herein for a specific method may also hold for any method described herein. Furthermore, it will be understood that for any system or method described herein, not necessarily all the components or steps described must be enclosed in the system or method, but only some (but not all) components or steps may be enclosed.

The term "coupled" (or "connected") herein may be understood as electrically coupled or as mechanically coupled, for example attached or fixed, or just in contact without any fixation, and it will be understood that both direct coupling or indirect coupling (in other words: coupling without direct contact) may be provided.

To achieve the stated features, advantages and objects, the present disclosure provides solutions that make use of computer hardware and software to provide a single-action locking and unlocking of a plurality of electronic locks. The single-action lock and unlock method and system of the present invention reduces the number of steps a user needs to take to open a system of multiple electronic locks. The present disclosure can be applied to an electronic lock with no capability of connection to a network or to a remote access management system or to an electronic lock that is configurable for access to a network or to a remote access management system. A person skilled in the art will appreciate that even though the present invention may detail the system and method of unlocking the plurality of electronic locks, a skilled person will appreciate that the system and method will similarly apply to a single action locking of the plurality of electronic locks. In other words, the phrase "single action lock and unlock" may be understood as a system and method of locking multiple electronic locks in a single action and/or as a system and method of unlocking multiple electronic locks in a single action.

Figure 2:
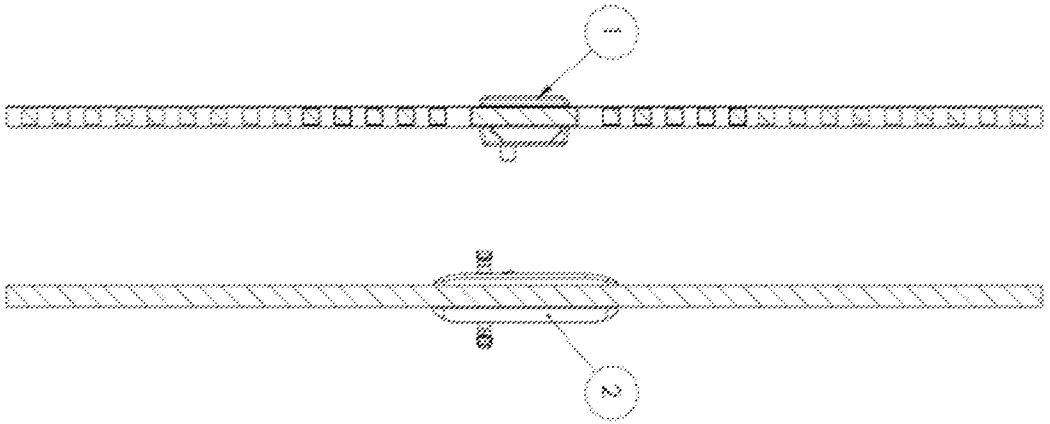
FIG. 2 shows a side view of a setup of a first physical barrier in front of a second physical barrier according to various embodiments.

FIGS. 1 and 2 are a perspective view and a side view respectively of an environment in which embodiments presented herein can be applied. Access to a plurality of restricted physical spaces is restricted by physical barriers, for example, a metal gate (1) and a door (2). In some physical spaces, for example, high rise apartments, condominiums, service apartments, hotels, houses, or the like, it may be typical to have a first physical barrier as a first entry point before accessing a second physical barrier as a second entry point before accessing an accessible physical space. The physical barriers stand between the respective restricted physical spaces and the accessible physical space. It is to be noted that the accessible physical space can be a restricted physical space in itself, but in relation to these physical barriers, the accessible physical space is accessible. The physical barriers can be doors, gates, hatches, cabinet doors, drawers, windows, etc.

Each of the first physical barrier and second physical barrier is controlled by a lock controller that locks and unlocks an electronic lock. The lock controller controls the electronic lock to be set in an unlocked state or locked state. In order to lock or unlock any one of these electronic locks associated with each physical barrier, a lock control device is provided. A user carries a lock control device that is configured to lock or unlock at least two electronic locks in a single action.

Figure 3:
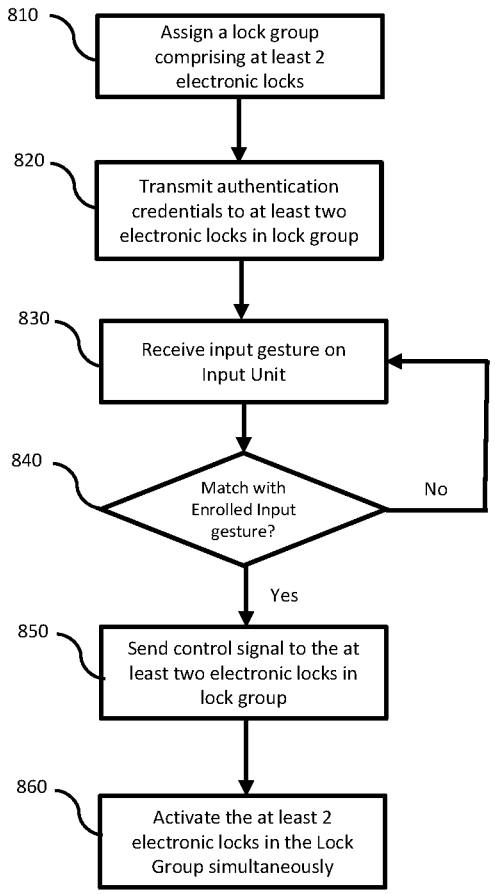
FIG. 3 illustrates a flow chart of a process for controlling a lock group using an input gesture received by a lock control device according to various embodiments.

FIG. 3 is a flow chart of a process for locking or unlocking a lock group using an input gesture received by a lock control device. The method is described in the context of an access management application, details of which will be explained hereinafter. In use, for example, an apartment may comprise a plurality of electronic locks, each of which is associated with a physical barrier. For example, a first electronic lock is installed at a gate as a first physical barrier and a second electronic lock is installed at a main door as a second physical barrier. The electronic locks are paired via the access management application on the lock control device via short range wireless communication protocols such as Bluetooth or BLE and cryptographic keys are exchanged upon pairing.

At Step 810, once panning between the lock control device and the access management application is achieved, a user can configure two or more electronic locks to be assigned to a lock group. In some embodiments, a user can assign electronic locks to more than one lock group. For example, within the apartment, there may be electronic locks on bedroom doors or the kitchen. The assignment of the electronic locks on the access management application can be done in the lock group module. Once the assignment of the lock group is done, the user can configure an input gesture to be mapped to the specific lock group so that the performance of the input gesture by the user will cause all the electronic locks in the lock group to be unlocked simultaneously via the input gesture. Details of the assignment of the input gesture to a lock group will be explained hereinafter.

At step 820, the lock control device 100 transmits authentication credentials to each of the electronic locks in the lock group for authentication purposes. The authentication credentials can be configured by the user for performing authentication of the user for each of the electronic locks. For example, the authentication credentials may be a unique passcode, a bluetooth key or secret key, or a biometric signature. In some embodiments, the electronic locks may be configured to receive a secret key from the lock control device that is in wireless communication with a lock group or an individual electronic lock. For example, when the user is within an active space or proximity of the electronic locks, an authentication process is activated. The active space can be defined as a space in which the lock control device or the electronic lock can detect each other's presence via short-range or long-range wireless communication protocols. In some embodiments, the lock control device 100 may include a location detection module that automatically activates the input unit of the lock control device when the lock control device 100 is within a predetermined geolocation around the lock group. In some embodiments, the location detection module may be a Global Positioning System (GPS) sensor that allows the lock control device to configure a virtual perimeter for the active space around the respective lock groups. When the user is in the active space, the authentication process is activated and each of the electronic locks are configured to wirelessly receive a secret key from the lock control device 100 without requiring any manual input in the electronic lock 210. The secret key, which involves the use of secret key cryptography using symmetric-key algorithms that are known by persons skilled in the art, are algorithms for cryptography that uses the same cryptographic keys for both encryption of plaintext and decryption of ciphertext.

At step 830, the user may be prompted to input an input gesture on the input unit for the respective lock group associated with the active space that the lock group is located in. In some embodiments, the user may access the lock control device and manually input an input gesture on the input unit for the respective lock group when he is in the active space and when the authentication process has completed. The input gesture may include a figure, pattern, or press. For example, a user may configure an input gesture in the shape of a 'O' to be mapped to a lock group for unlocking all the electronic locks associated with lock group 1. Alternatively, the user may configure an input gesture in the shape of a "V" to be mapped to the lock group for unlocking all the electronic locks associated with the lock group. In other embodiments, the user may configure an input gesture to simply press a virtual button on an input unit to be mapped to the lock group. When the lock control device has completed the authentication process, the lock control device can receive an activation signal from the electronic lock or the lock group via short range wireless communication protocols to cause the lock control device to activate an input unit on the display of the lock control device for receiving the input gesture. For example, the input event occurs when the user is within an active space located within the proximity of the lock group and receives an activation signal from the electronic lock or the lock group.

At step 840, the lock control device will determine if the received input gesture corresponds to a predetermined or enrolled input gesture that had been configured for the lock group. The received input gesture may be compared to an input gesture that had been enrolled previously and saved in the storage of the lock control device when the user was configuring the input gesture to the respective lock group. If the input gesture corresponding to the predetermined input gesture is determined, the lock control device will send a control signal to each of the electronic locks associated with the lock group at step 850. If the received input gesture does not correspond or match to the enrolled input gesture stored in the storage of the lock control device, the lock control device may determine the received input gesture as an error, and may instruct the user to retry the input gesture. If there is a match between the received input gesture and the enrolled input gesture, the lock control device sends a control signal to each of the electronic locks associated with the lock group that is being locked or unlocked. The control signal is received by the lock controllers of the respective electronic locks and activates the lock controller to be in the activated state simultaneously. If the control signal is an unlock signal, the activated state triggers the opening of the physical lock to the unlock state at step 860. If the control signal is a lock signal, the activated state triggers the closing of the physical lock to the locked state at step 860.

Figure 4:
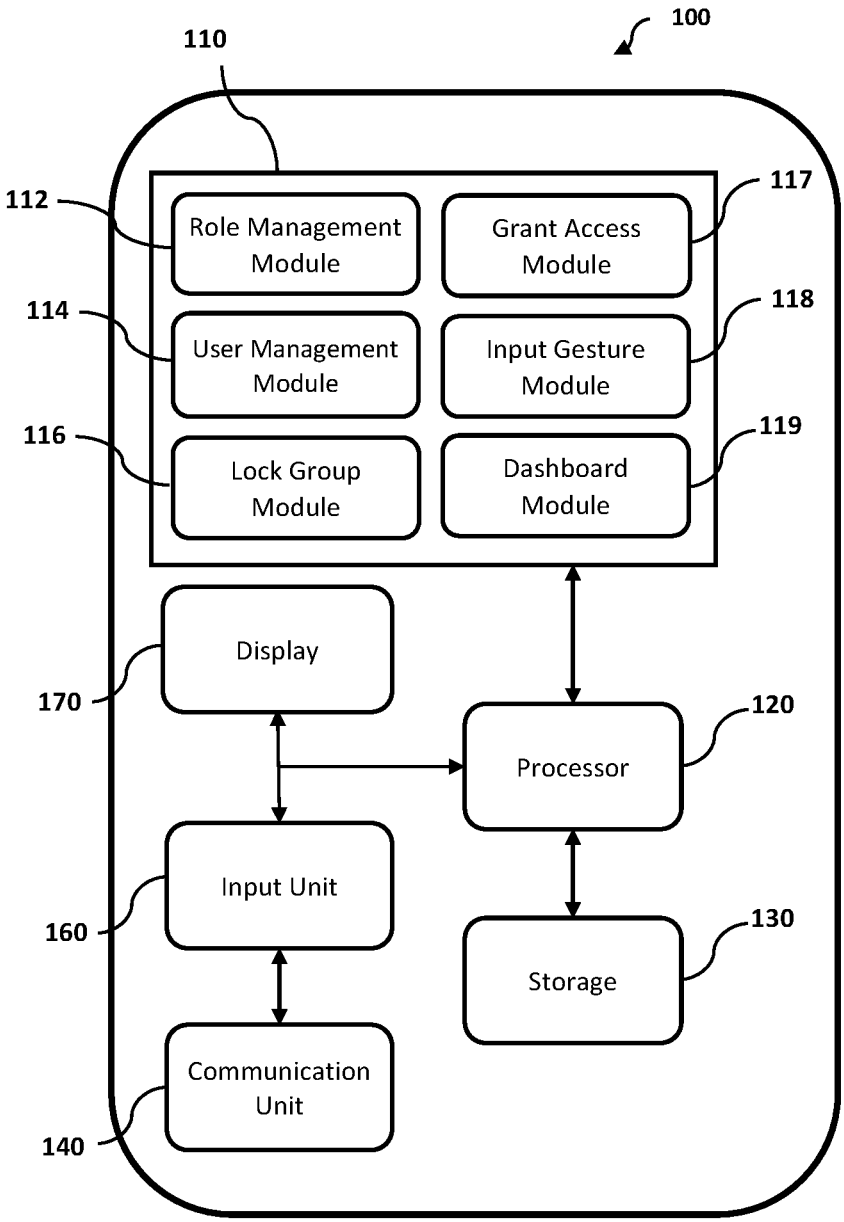
FIG. 4 shows a high-level overview of a lock control device according to various embodiments.

FIG. 4 is an illustration of a lock control device 100 that may include a communication platform or an access management application 110 that is operable on the lock control device 100. The lock control device 100 may include a display 170, a processor 120, an input unit 160, a communication unit 140 and a storage 130. In some embodiments, any other suitable component, including but not limited to a system bus or a controller (not shown), may also be included in the lock control device 100. In some embodiments, a mobile operating system (e.g., iOS™, Android™, Windows Phone™, etc.) and one or more applications (not shown), for example, the access management application 110, may be loaded into a memory (not shown) from the storage 130 in order to be executed by the processor 130. The applications may include a browser or any other suitable mobile apps for receiving information relating to the access management application 110. As appreciated by a person skilled in the art, user interactions with the information stream may be achieved via the I/O devices (not shown) and provided to the processor and/or other components of the system 100 via the network 500.

The lock control device 100 may be a computer, laptop, handheld computer, mobile communication device, smartphone, tablet, IoT device, a key fob, a hardware token, a software token, or any other device. In some embodiments, the lock control device 100 is capable of sending and/or receiving data over a communication network via short-range wireless communication protocols such as Bluetooth or Bluetooth Low Energy (BLE). In some embodiments, the lock control device 100 is capable of transmitting data via Radio Frequency Identification (RFID) or Ultra High Frequency (UHF).

FIG. 4 depicts a lock control device 100 that includes a display and an input unit. The display unit and the input unit can be a single entity although it is shown separately. The input unit 160 is configured to receive input alphanumeric information and various input signals to set the functions and access controls of the electronic locks, and to send the input information and signals to the lock controller of the electronic lock. In some embodiments, the input unit may include a touch screen, a touch pad, a remote controller device, a key pad that is capable of receiving an input gesture. In some embodiments, the input unit may integrated with the display. In some embodiments, the input unit may function without a display and may include a physical button configured to be depressed to send a control signal.

Figure 6A:
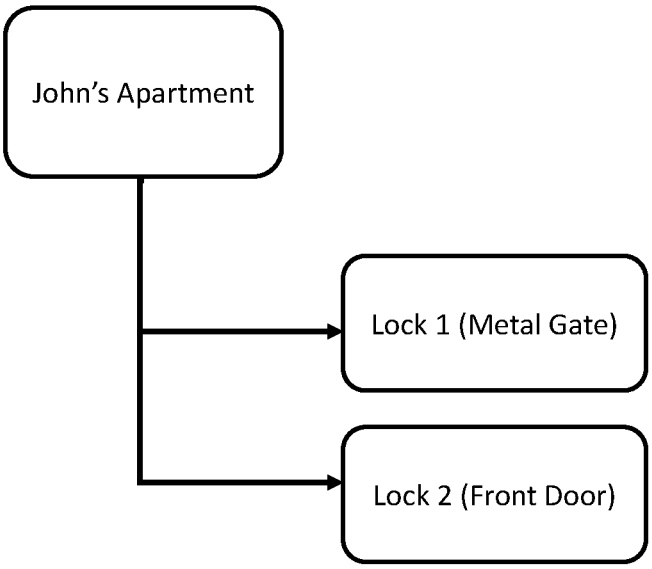
FIG. 6(*a*) shows a plurality of locks that are accessible at various entry points within an environment on the access management application according to various embodiments.
Figure 6B:
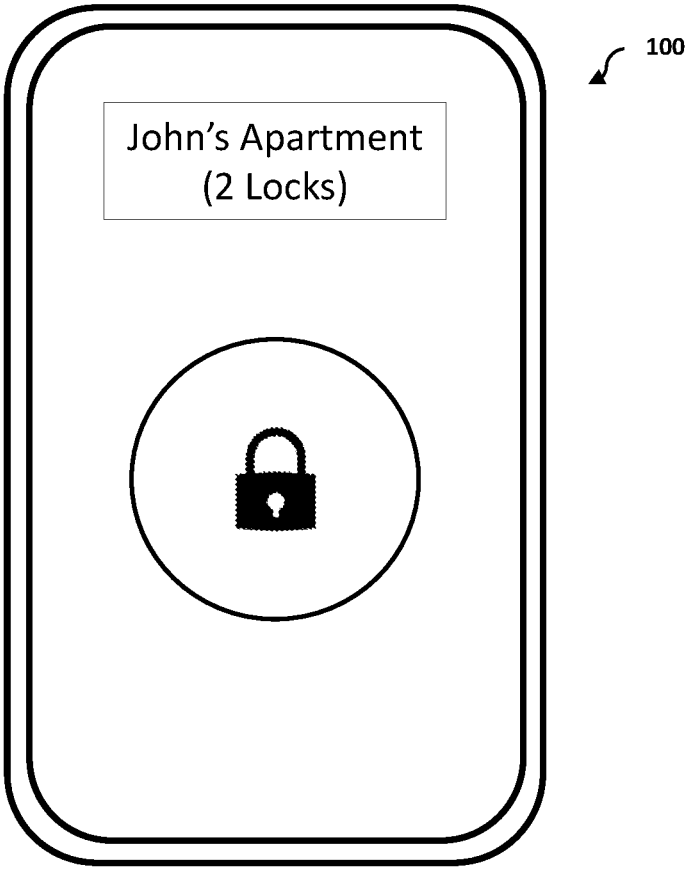

The access management application 110 includes a lock group module 116 that is configured to assign at least two electronic locks in the physical space to one lock group for a single action lock and/or unlock. In some embodiments, the lock group module 116 provides an overview of the electronic locks in a physical space under management. FIG. 6(*a*) shows a plurality of locks that are accessible at various entry points in a home. For example, referring to FIG. 6(*a*), John's apartment can include an electronic lock 1 at a first physical barrier which may be a metal gate and an electronic lock 2 at a second physical barrier which may be the front door. Through the lock group module 116 on the access management application 110, the user can assign from two or more electronic locks, for example, electronic lock 1 and electronic lock 2 to a lock group A, and electronic lock 3 and electronic lock 4 to lock group B. Once the lock group A and lock group B is configured and saved, both lock groups are saved in the storage 130 of the lock control device 100.

The electronic locks that are associated in a lock group indicates that the locks are meant to be locked and/or unlocked together by an input gesture that is enrolled or configured into the input gesture module 118 and mapped to the lock group. The lock group could be the physical property or home or could be a user created logical grouping. The user then performs the associated input gesture on the lock control device, to lock and/or unlock all the locks in the associated lock group. In the case of an unlock function, the communication unit of the lock control device then sends an unlock activation signals wirelessly to each of the locks in the associated lock group. These unlock commands may be sent simultaneously or sequentially. After the locks unlock after receiving the unlock commands wirelessly, a response may be sent back to the user device to inform the user of the outcome of the lock group unlock operation.

The input unit 160 is also configured to receive an input gesture configured to unlock a lock group that may include at least two electronic locks. The access management application 110 may include an input gesture module 118 associated with a mapping function for assigning an input gesture to a respective lock group. The grant access module can then determine whether the predetermined input gesture matches with the enrolled input gesture that was saved for unlocking a specific lock group. A user may setup various options for configuring a specific lock group to a desired input gesture. The input gesture may include a figure, pattern, or press. For example, a user may configure an input gesture in the shape of a 'O' to be mapped to lock group 1 for unlocking all the electronic locks associated with lock group 1. The user may configure an input gesture in the shape of a "V" to be mapped to lock group 2 for unlocking all the electronic locks associated with lock group 2. In some embodiments, the user may configure an input gesture to simply press a virtual button on an input unit to be mapped to lock group 3. For example, FIG. 6(*b*) shows a user interface display of an input unit on the lock control device that features a virtual button for a user to press for sending a control signal to each of the plurality of electronic locks. The control signal can be a lock or an unlock signal depending on which signal the user chooses. In some embodiments, the input gesture may correspond to the number, amount of time and/or strength of press input, for example, one or two presses, a long press input or short press input based on a time threshold for determining pressing duration and/or strength for transmitting the control signal to the electronic locks in the lock group. Each of the input gestures for locking or unlocking the one or more lock groups can be changed, added or deleted by way of configuration by the user on the input gesture module.

The term "gesture" refers to, but not limited thereto, the actions of a user such as a pattern, a figure or a press, drag, and the like, particularly on a lock control device or on the input unit. The term "figure" refers to, but not limited thereto, any dragging action that may be made by a user. Furthermore, the gesture can be deemed as a pattern, a figure, a press, or the combination of the one or more of the aforesaid actions.

The display 170 is configured to display screen data generated by the operation of the lock control device or the access management application, and to display status information according to the user function based on user settings. The display may display various screen data associated with the operations of the access management application for control of the lock group and each electronic lock associated with the lock group.

The communication unit 140 is configured to communicate wirelessly via range wireless communication protocols, for example, short range or long range wireless communication protocols, with the respective lock groups or individual electronic locks. The communication unit 140 may include a wireless transceiver for transmitting and receiving data for performing functions associated with the lock group or individual electronic lock. In some embodiments, the functions may include pairing or authentication of the electronic locks or locking and unlocking functions of the lock group.

The access management application 110 may be used in homes or real estate management operators such as commercial buildings, hotels, co-living spaces, serviced apartments, suites, short-term accommodation units, groups of apartment units managed by a single operator. The access management application 110 may include several modules including a user management module 114, a role management module 112, a lock group module 116, a grant access module 117, an input gesture module 118, and a dashboard module 119. The access management application 110 include various modules that are accessible by users via a mobile application installed on the lock control device 100 for configuration and assignment of lock groups for a plurality of electronic locks for multiple entry points each secured by an electronic lock. A mobile or a web application can be a mobile or a web application that runs and be executed on, for example, the lock control device.

In some embodiments, the access management application 110 can be accessed via the lock control device and allows the lock control device to control the electronic locks via short range wireless communication protocols such as Bluetooth or Bluetooth Low Energy by pairing the lock control device with the electronic lock. When this is done, the user can edit or delete passcodes, create customised unique passcodes, or synchronize the data within the lock control device to the electronic lock.

The access management application 110 also includes a role management module 112 that creates and defines roles for different types of people who may be permanent or temporary visitors to the physical space. The authorisation may comprise assigning and/or creating roles and customizing permission levels for the assigned or created roles with different access rights to a lock group. Roles may be pre-configured or certain roles could be created by the administrator with different permission levels for the different modules in the access management application. In some embodiments, the administrator or the access right owner can assign roles to visitors who may only have temporary access to the entry points for a predetermined duration of time or predetermined time slot on a regular interval. For example, a cleaner who cleans an apartment at a regular scheduled day a week for a specific duration of time. In each of these cases, the administrator or access right owners can assign a role for each of these cases and to authorize each role with temporary access rights to the associated lock groups via the grant access module 118.

The access management application 110 includes a grant access module 117 that is configured to manage, provision and grant access to specific access right grantees with assigned roles (by the role management module 110) to a specific electronic lock or a to a group of electronic locks. The access granted may be one-time or over a specific duration or interval. Multiple users may be granted access to multiple locks. For example, the administrator or access right owner may grant a real estate agent temporary access rights to the physical space to show to potential buyers or tenants during a defined period of time.

The administrator can configure how each electronic lock is to be accessed or authenticated. For example, the electronic lock can be configured to be accessed by a unique passcode, a bluetooth key or secret key, or biometric signature. When an electronic lock is provisioned to the owner or access right owners, additional useful information including geolocation, grouping and informative tags may be captured. For example, the electronic locks may be configured to receive a secret key from the lock control device that is in wireless communication with a lock group or an individual electronic lock. For example, the electronic lock may include a wireless transceiver and processor that are configured to wirelessly receive a secret key from the lock control device without requiring any manual input in the electronic lock. The secret key, which involves the use of secret key cryptography using symmetric-key algorithms, are algorithms for cryptography that uses the same cryptographic keys for both encryption of plaintext and decryption of ciphertext and are well-known in the art. In some embodiments, the lock control device may also retrieve the secret key from an access management application on the lock control device.

Figure 5:
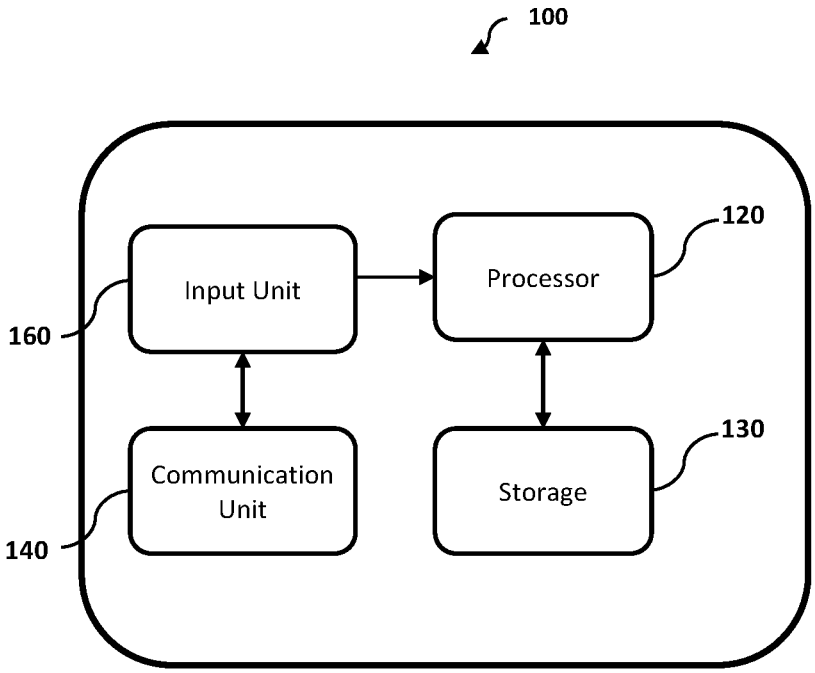
FIG. 5 shows a high-level overview of an alternative lock control device according to various embodiments.

FIG. 5 is an illustration of another embodiment of a lock control device 100. In this embodiment, the lock control device 100 may include an input unit 160, a processor 120, a communication unit 140, and a storage 130. The lock control device 100 may not have a display or an access management application. Assignment of electronic locks to a lock group and configuration of input gestures for specific lock groups can be configured by a remote mobile communication device. Interactions with the lock group or individual electronic locks can be achieved via short range wireless communication protocols with a mobile communication device. The lock control device may have an input unit configured to receive an input gesture configured to unlock a lock group that may include at least two electronic locks. The input gesture may include one or more presses of a physical button on an input unit to be mapped to lock group 3. For example, FIG. 6(*b*) shows a user interface display of an input unit on the lock control device that features a virtual button for a user to press for sending a control signal to the individual locks within the lock group. In some embodiments, the input gesture may correspond to the number, amount of time and/or strength of press input, for example, one or two presses, a long press input or short press input based on a time threshold for determining pressing duration and/or strength for transmitting the control signal to the electronic locks in the lock group. Each of the input gestures for locking and/or unlocking the one or more lock groups can be changed, added or deleted by way of configuration by the user on the input gesture module.

Figure 7:
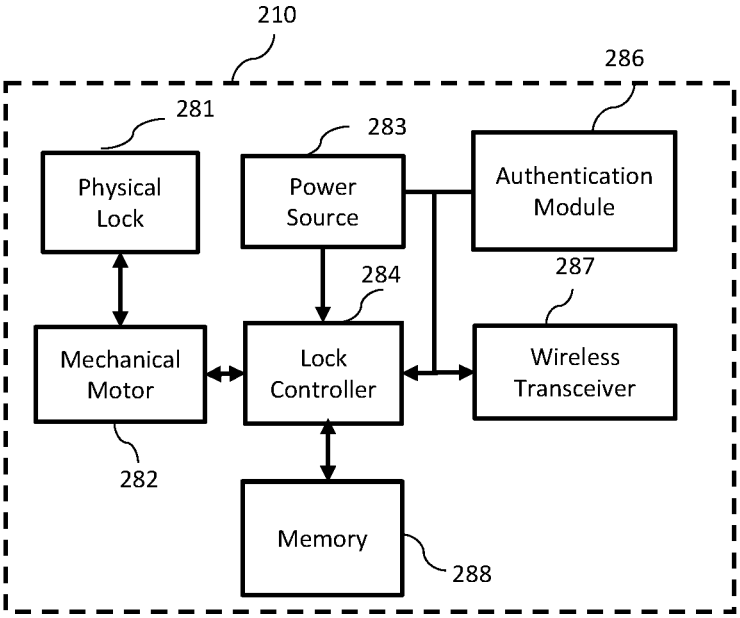
FIG. 7 shows a high-level overview of an electronic lock according to various embodiments.

FIG. 7 illustrates a high-level block diagram showing the internal components of an electronic lock 210 configured for wireless communication with the network and/or lock control device 100 according to various embodiments. The electronic lock 210 is installed on an entry point of an object, property or key installation. The entry point may include a door, such as a door of a building, a door in a residential or commercial unit, a door of a cabinet, a door of a safe, a door of a vehicle, door of a container, door of a key installation, etc. The electronic lock 210 comprises a lock controller 284 in data communication with a memory 288 and a wireless transceiver 287, a power source 283 and a mechanical motor 282 coupled to a physical lock 281. In some embodiments, the electronic lock 210 includes an input device (not shown) such as a touch screen or a virtual keypad for entering an input. In some embodiments, the electronic lock 210 includes a biometric sensor for capturing biometric data such as a fingerprint sensor for capturing fingerprint information or an image capturing sensor for capturing facial profile information of users. In some embodiments, in the absence of a biometric sensor on the electronic lock 210, the biometric data may be obtained from a lock control device 100 in wireless communication with the electronic lock 210.

The electronic lock 210 includes a wireless transceiver 287 for wireless communication with an access management application 110 on a lock control device 100 or a server via a network 500. In some embodiments, the wireless transceiver 287 can communicate wirelessly with a lock control device 100 or a gateway device 510 via the network 500. In various embodiments, the wireless transceiver 287 can communicate via any of various technologies already mentioned above, such as a cellular network, a short-range wireless network, a wireless local area network (WLAN), a low-power Wide Area Network (LP-WAN), etc. The cellular network can be any of various types, such as code division multiple access (CDMA), time division multiple access (TDMA), global system for mobile communication (GSM), long term evolution (LTE), 3G, 4G, 5G, etc. The short-range wireless network can also be any of various types, such as Bluetooth, Bluetooth Low Energy (BLE), near field communication (NFC) etc.

In some embodiments, the electronic lock 210 also includes the standard structure of conventional door locks with moving parts to lock or to unlock the door. The electronic lock 210 can be installed on any door that provides access to a building, residential unit, room, hotel room, car, safe, cabinet, or the like. The lock controller 284 controls a mechanical motor 282 which causes the mechanical motor 282 to open or close the physical lock 281. The mechanical motor 282 can have the associated gears in order to generate the torque required to move the physical lock 281. The physical lock 281 may take many form factors including padlocks, deadbolts, mortises, rim locks, latches and electro-magnetic door locks. The lock controller 284 includes a memory 288 that stores digital keys, biometric data, access details, logs of user interactions or associated timestamps and a record of the owner or administrator data. The memory 288 may be a volatile memory, for example a DRAM (Dynamic Random Access Memory) or a non-volatile memory, for example a PROM (Programmable Read Only Memory), an EPROM (Erasable PROM), EEPROM (Electrically Erasable PROM), or a flash memory, e.g., a floating gate memory, a charge trapping memory, an MRAM (Magneto resistive Random Access Memory) or a PCRAM (Phase Change Random Access Memory).

As used herein, the term 'controller' broadly refers to and is not limited to single or multi-core general purpose processor, a special purpose processor, a conventional processor, a graphical processing unit, a digital signal processor (DSP), a plurality of microprocessors, one or more microprocessors in association with a DSP core, a controller, a microcontroller, one or more Application Specific Integrated Circuits (ASICs), one or more Field Programmable Gate Array (FPGA) circuits, any other type of integrated circuit, a system on a chip (SOC), and/or a state machine.

The lock controller 284 cooperates with the authentication module 286 to authenticate the user based upon an authentication request received from the lock control device 100. When the user is within an active space or proximity of the electronic lock 210, an authentication process may be activated. For example, the lock control device 100 may include a location detection module that automatically activates the input unit of the lock control device when the lock control device 100 is within a predetermined geolocation around the lock group. In some embodiments, the location detection module may be a Global Positioning System (GPS) sensor that allows the lock control device to configure a virtual perimeter for the active space around the respective lock groups. When the user is in the active space, the authentication process is activated and the wireless transceiver 287 is configured to wirelessly receive a secret key from the lock control device 100 without requiring any manual input in the electronic lock 210. The secret key, which involves the use of secret key cryptography using symmetric-key algorithms, are algorithms for cryptography that uses the same cryptographic keys for both encryption of plaintext and decryption of ciphertext and are well-known in the art. The user may then proceed to perform the predetermined input gesture on the display of the lock control device 100, which may include a figure, pattern or virtual button. that is matched with a password of the user stored in the password database 150.

The power source 283 provides power supply to the electronic lock 210. The power source can be a battery energy source, for example, a rechargeable battery.

Figure 8:
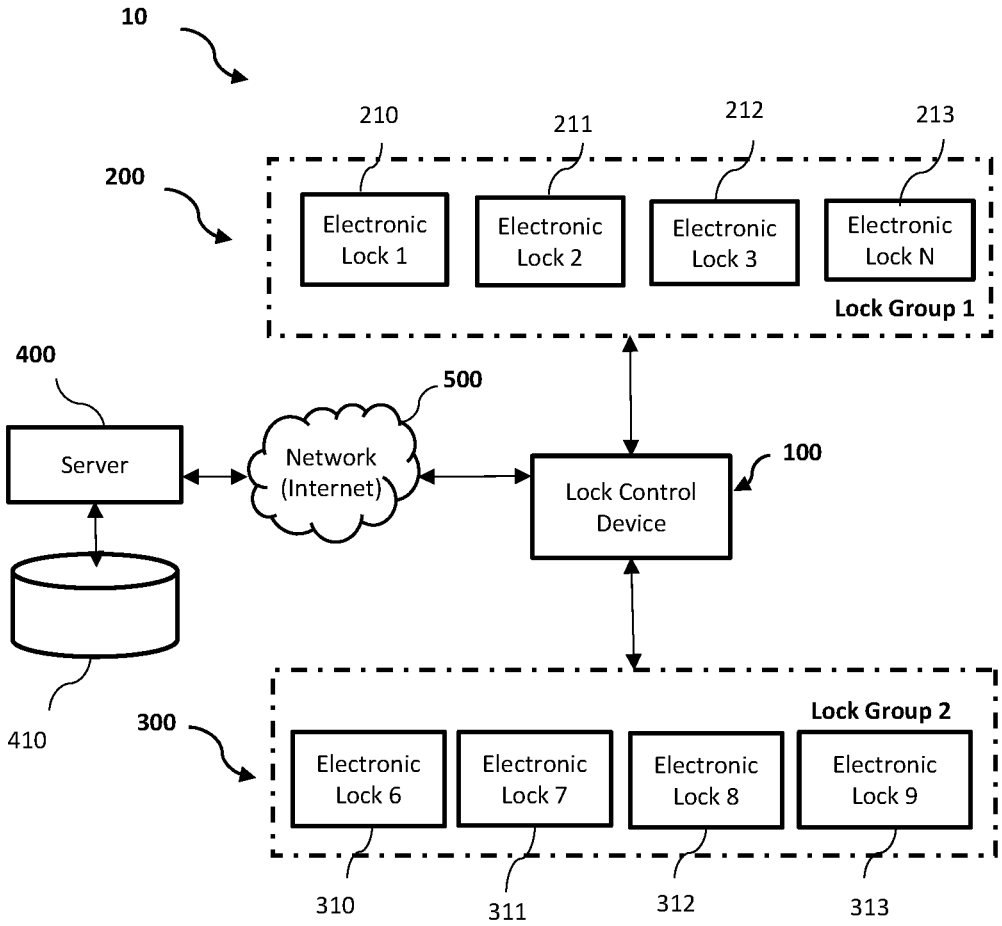
FIG. 8 shows a high-level overview of the access management system interacting with other components of the system according to various embodiments.

FIG. 8 shows a high-level overview of an access management system 10 according to various embodiments of the invention. For example, the access management system 10 may be a platform for providing lock management services to one or more users for the management of one or more lock groups of electronic locks for a property. The access management system 10 may include a server 400, a network 500, a lock control device 100 and one or more lock groups 200, 300, each lock group comprising at least two electronic locks. The lock control device 100 is configured to control one or more lock groups of electronic locks (200, 300) via a network 500 according to various embodiments. The server 400 may be configured to process information and/or data relating to the management of electronic locks for a property. For example, the server may determine how a plurality of electronic locks may be grouped into one or more lock groups for the purpose of configuring a lock group for a single action lock and/or unlock of the plurality of electronic locks in that lock group. The server 400 is arranged in data communication with a storage 410 which may store relevant data about the lock control device 100, associated groups of electronic locks and their associated lock IDs, locations, access right owners, access right grantees, etc. The storage 410 may be maintained on an application server or on a separate server available for communication over a private network. The server is in communication with a lock control device or other lock control devices over the network 500.

In some embodiments, the server 400 may include a processor (not shown). The processor may process information and/or data relating to lock management services configured to perform one or more functions described in the present disclosure. For example, the processor may process data relating to assigning or controlling one or more lock groups comprising more than one electronic locks via the access management application 110 on a lock control device 100. In some embodiments, the processor may include one or more processing engines (e.g., single-core processing engine (s) or multi-core processor (s)). Merely by way of example, the processor may be one or more hardware processors, such as a central processing unit (CPU), an application-specific integrated circuit (ASIC), an application-specific instruction-set processor (ASIP), a graphics processing unit (GPU), a physics processing unit (PPU), a digital signal processor (DSP) a field programmable gate array (FPGA), a programmable logic device (PLD), a controller, a microcontroller unit, a reduced instruction-set computer (RISC), a microprocessor, or the like, or any combination thereof.

The network 500 may facilitate exchange of information and/or data between the lock control device 100 and the server 400. In some embodiments, the lock control device 100 is in wireless communication with the server 400 through the network 500. As used herein, the term 'network' refers to a Local Area Network (LAN), a Metropolitan Area Network (MAN), a Wide Area Network (WAN), a proprietary network, and/or Internet Protocol (IP) network such as the Internet, an Intranet or an extranet. Each device, module or component within the system may be connected over a network or may be directly connected. A person skilled in the art will recognize that the terms 'network', 'computer network' and 'online' may be used interchangeably and do not imply a particular network embodiment. In general, any type of network may be used to implement the online or computer networked embodiment of the present invention. The network may be maintained by a server or a combination of servers or the network may be serverless. Additionally, any type of protocol (for example, HTTP, FTP, ICMP, UDP, WAP, SIP, H.323, NDMP, TCP/IP) may be used to communicate across the network. The devices as described herein may communicate via one or more such communication networks.

In use, and in accordance with the process flow as shown in FIG. 3, an apartment may comprise a plurality of electronic locks, each of which is associated with a physical barrier. The electronic locks are paired via the access management application on the lock control device via short range wireless communication protocols such as Bluetooth or BLE and cryptographic keys are exchanged upon pairing. Once pairing between the lock control device and the access management application is achieved, a user configures two or more electronic locks to be assigned to a lock group. Once the assignment of the lock group is done, the user can configure an input gesture to be mapped to the specific lock group so that the performance of the input gesture by the user will cause the lock control device to transmit a control signal which includes a lock signal or an unlock signal to all the electronic locks in the lock group to be locked or unlocked simultaneously via the input gesture.

When the user is within an active space or proximity of the electronic locks or lock group, an authentication process is activated. The lock control device 100 transmits authentication credentials to each of the electronic locks in the lock group for authentication purposes. The authentication credentials can be configured by the user for performing authentication of each of the electronic locks and each electronic lock may have a different authentication credential from another electronic lock. For example, the authentication credentials may be a unique passcode, a bluetooth key or secret key, or a biometric signature. For example, when the user is in the active space, the authentication process is activated and each of the electronic locks are configured to wirelessly receive a secret key from the lock control device 100 without requiring any manual input in the electronic lock 210. Once the authentication process is completed, the input unit is activated on the lock control device for the user to input an input gesture on the input unit. When the user inputs the input gesture on the input unit, the lock control device will determine if the received input gesture corresponds to a predetermined or enrolled input gesture that had been configured for the lock group. The received input gesture may be compared to an input gesture that had been enrolled previously and saved in the storage of the lock control device. If the input gesture corresponding to the predetermined input gesture is determined, the lock control device will send a control signal to each of the electronic locks associated with the lock group. If the received input gesture does not correspond or match to the enrolled input gesture stored in the storage of the lock control device, the lock control device may determine the received input gesture as an error, and may instruct the user to retry the input gesture. If there is a match between the received input gesture and the enrolled input gesture, the lock control device sends a control signal which includes either a lock signal or an unlock signal to each of the electronic locks associated with the lock group that is being locked or unlocked. The control signal is received by the lock controllers of the respective electronic locks and activates the lock controller to trigger the closing or opening of the physical lock to the locked or unlocked state simultaneously.

With reference to FIG. 8, the lock control device 100 may include sensors or transceivers that are capable of using low power wireless transmission standards such as ZWave, Zigbee or Bluetooth low energy to communicate with the one or more lock groups. Each electronic lock in the lock groups 200, 300 may similarly include sensors or transceivers that are capable of using low power wireless transmission standards such as ZWave, Zigbee or Bluetooth low energy to communicate with the lock control device 100 with the advantage of lower cost, longer battery life and higher connection density. In some embodiments, the lock control device 100 is capable of transmitting data via Radio Frequency Identification (RFID) or Ultra High Frequency (UHF) to be received by each lock group or individual electronic lock. For example, the lock control device 100 is capable of sending control signals associated with the locking or unlocking of one or more lock groups through a single action of the user on the lock control device 100.

Figure 9:
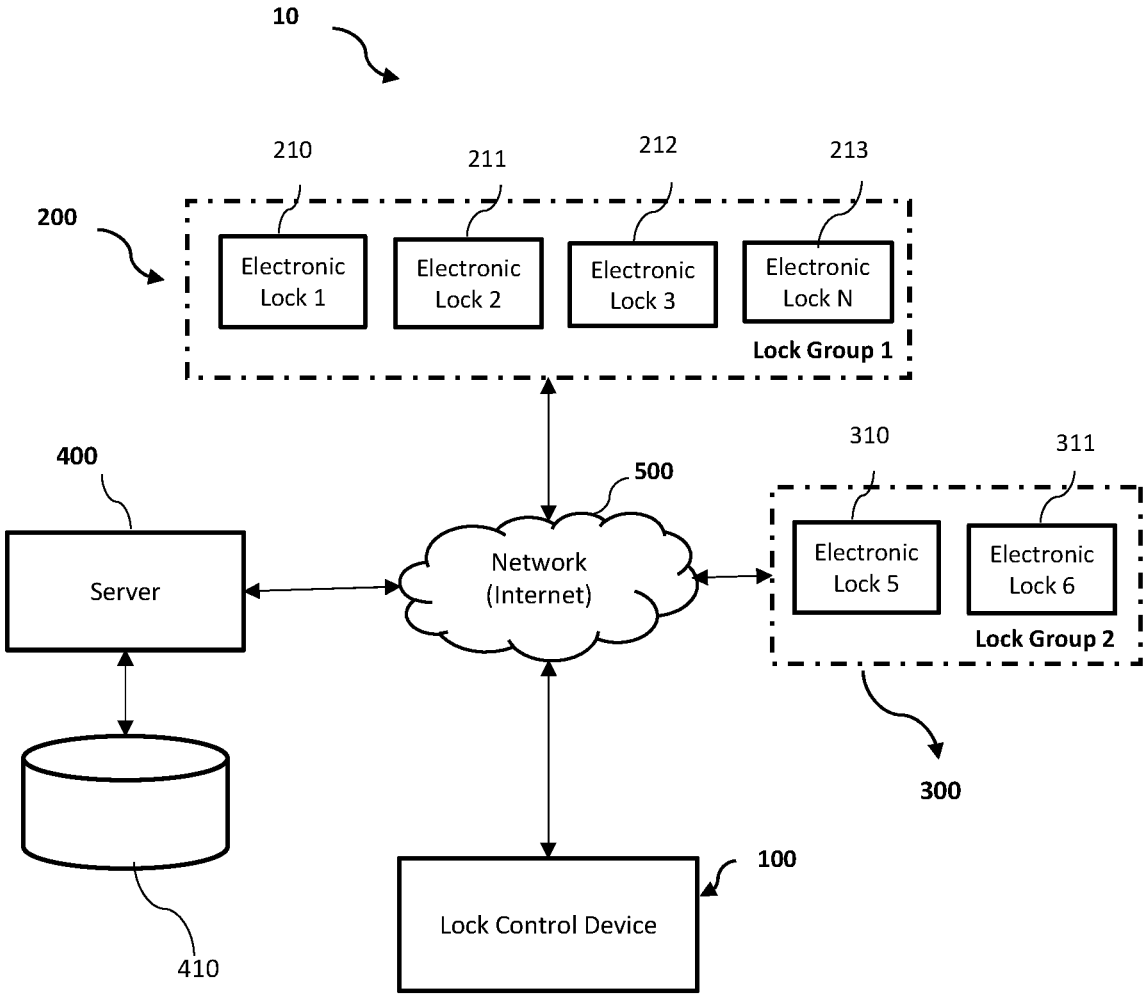
FIG. 9 shows a high-level overview of another access management system interacting with other components of the system according to various embodiments.

FIG. 9 shows a high-level overview of another embodiment of an access management system 10 according to various embodiments of the invention. In this embodiment, the lock control device 100 controls one or more lock groups 200, 300 through the network 500. For example, each electronic lock 210-213 may include a sensor or a wireless transceiver that are capable of connecting to the network 500 via low power wireless transmission standards such as ZWave, Zigbee or Bluetooth low energy. The electronic locks 210-213 include sensors equipped with such low power wireless technology, and are connected to the network 500.

In this embodiment, while the steps for sending a control signal to the individual electronic locks are similar to the steps as described above, the mode of transmission may be different. When the user performs the input gesture on the input unit of the lock control device and the received input gesture matches the enrolled input gesture, the lock control device 100 sends the control signal to the electronic locks via the network 500 and/or the server 400, and the server receives an instruction from the server to lock and/or unlock all the locks in the lock group. The instruction may be a single control signal, which may then be broken down into respective lock or unlock signals (depending on the type of control signal) corresponding to each electronic lock in the lock group, and wirelessly communicated to each electronic lock in the lock group.

Figure 10:
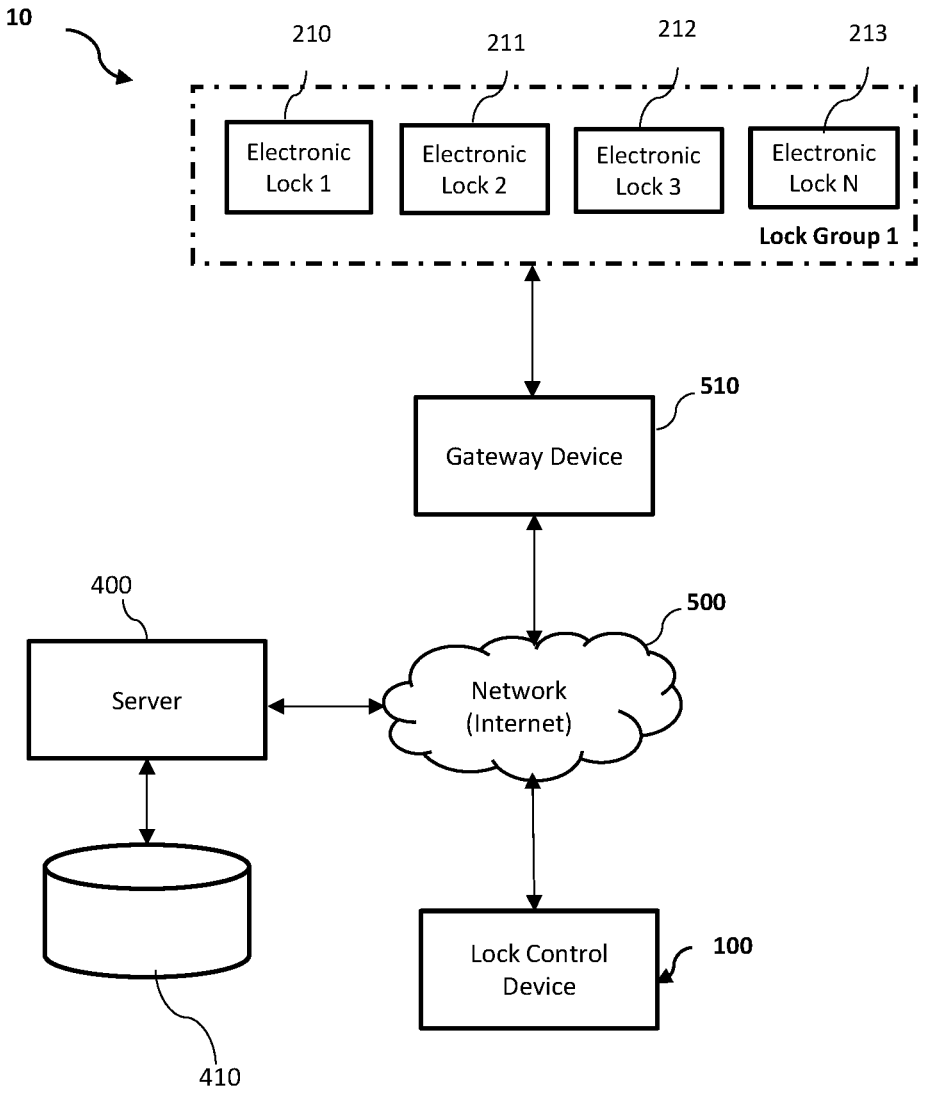
FIG. 10 shows a high-level overview of another access management system interacting with other components of the system according to various embodiments.

FIG. 10 is an illustration of yet another embodiment of an access management system 10. In this embodiment, Lock Group 1 comprising a plurality of electronic locks 210-213 are arranged in wireless communication with a gateway device 510 over a network 500. In some embodiments, the electronic locks 210-213 can be connected to the network 510 via one or more gateway devices 510. The gateway device 510 receives data from the lock group 200 and communicates with the lock control device 100 through the network to upload individual or aggregated data from the individual lock or the lock group, to send and to receive data from and to the lock control device 100 or to the server 400. The gateway device 510 may also communicate with other gateway devices to provide load balancing of sensor platforms, sensor platform handoff, data aggregation and filtering, and exchange of sensor platform encryption keys, and so forth. Each gateway device 510 may be participating in a cluster of lock groups, and is typically beneficial that the overall system operates effectively. In some embodiments, the electronic locks 210-213 include sensors or wireless transceivers that are capable of connecting to the network 150 via low power wireless transmission standards such as ZWave, Zigbee or Bluetooth low energy. The electronic locks 210-213 include sensors equipped with such low power wireless technology, and are connected to the network 500 via the gateway device 510.

In this embodiment, while the steps for sending a control signal which can include a lock and/or unlock signals to the individual electronic locks are similar to the steps as described above, the mode of transmission of the control signal may be different. When the user performs the input gesture on the input unit of the lock control device and the received input gesture matches the enrolled input gesture, the lock control device 100 sends the control signal to the electronic locks via the network 500 to gateway device 510. The instruction may be a single control signal, which may then be broken down into respective lock or unlock signals corresponding to each electronic lock in the lock group, and wirelessly communicated to each electronic lock in the lock group. Subsequently the single lock or unlock signal is sent to the server, and the gateway device receives an instruction from the server to lock or unlock all the locks in the lock group. This single control signal is then broken down into individual lock or unlock signals at the gateway device, and wirelessly communicated to each lock in the lock group. Alternatively, separate control signals for each lock in the lock group may be communicated to the gateway device from the server. The locks in the lock group will lock or unlock after receiving the unlock signals from the gateway device. The gateway device will inform the access management application on the lock control device once the unlock operation is concluded.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A method for controlling access to a restricted physical space, the method being performed by one or more processors of a computing system, comprising:

assigning a plurality of electronic locks to a lock group, wherein each of the plurality of electronic locks are associated with a physical barrier in the restricted physical space;

transmitting authentication credentials to each of the plurality of electronic locks when a lock control device enters an active space of the restricted physical space;

authenticating the lock control device, by each of the plurality of electronic locks, in response to a successful authentication of the authentication credentials;

receiving, by the lock control device, an input gesture on an input unit;

determining, by the lock control device, that the input gesture corresponds to an enrolled input gesture associated with the lock group; and transmitting a control signal to each of the plurality of locks associated to the lock group in response to a successful match of the input gesture with the enrolled input gesture associated with the lock group so as to cause each of the plurality of locks associated with the lock group to be in the activated state simultaneously.

2. The method according to claim 1, wherein the control signal comprises an unlock signal.

3. The method according to claim 1, wherein the control signal comprises a lock signal.

4. The method according to claim 2, wherein the each of the plurality of locks in the activated state is unlocked simultaneously.

5. The method according to claim 3, wherein the each of the plurality of locks in the activated state is locked simultaneously.

6. The method according to claim 1, wherein the input gesture includes any one of the following a pattern, a figure or a press.

7. The method according to claim 1, wherein the enrolled input gesture is configured to map to the lock group corresponding to each of the plurality of locks.

8. The method according to claim 1, wherein determining that the input gesture corresponds to the enrolled input gesture comprises:

comparing the input gesture with at least one predetermined input gesture stored as the enrolled input gesture.

9. The method according to claim 1, further comprising:

activating, in response to a successful authentication of the authentication credentials, an input unit on the display of the lock control device for receiving an input gesture of the user.

10. The method according to claim 1, further comprising:

receiving, by the each of the plurality of electronic locks, a notification that the each of the plurality of electronic locks are in the unlocked state.

11. The method according to claim 1, wherein the authentication credentials is any one of the following: a unique passcode, a Bluetooth key, a secret cryptographic key or a biometric signature.

12. The method according to claim 1, wherein the active space is a predetermined virtual perimeter from the lock group.

13. The method according to claim 1, wherein the lock control device is a key fob.

14. The method according to claim 1, wherein the lock control device is a mobile device.

15. An electronic lock configured to control access to a restricted physical space, the electronic lock being one of a plurality of electronic locks associated with a lock group configured to control the plurality of electronic locks simultaneously, the electronic lock comprising:

a lock controller;

a processor;

and a memory storing instructions that, when executed by the processor, cause the electronic lock to:

receive authentication credentials from a lock control device when the lock control device enters an active space of the restricted physical space;

authenticate the lock control device in response to a successful authentication of the authentication credentials; and receive a control signal from the lock control device, the control signal being sent to the plurality of locks associated with the lock group, in response to a successful match of an input gesture with the enrolled input gesture associated with the lock group so as to cause the electronic lock and the plurality of locks associated with the lock group to be in the activated state simultaneously.

16. The electronic lock according to claim 15, wherein the control signal comprises an unlock signal.

17. The electronic lock according to claim 15, wherein the control signal comprises a lock signal.

18. The electronic lock according to claim 16, wherein the electronic lock and the plurality of locks associated with the lock group in the activated state is unlocked simultaneously.

19. The electronic lock according to claim 17, wherein the electronic lock and the plurality of locks associated with the lock group in the activated state is locked simultaneously.

20. The electronic lock according to claim 15, wherein the input gesture includes any one of the following: a pattern, a figure or a press.

* * * * *